US006017235A

United States Patent [19]

Sawada et al.

[11] Patent Number: 6,017,235

[45] **Date of Patent: *Jan. 25, 2000**

[54] BULB SOCKET

[75] Inventors: Hisashi Sawada, Mie; Tadashi Harada, Shizuoka, both of Japan

[73] Assignees: Koito Manufacturing Co., Ltd,, Tokyo; Sumitomo Wiring System Ltd., Yokkaichi, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,901

[22] Filed: Jul. 29, 1997

[30] Foreign Application Priority Data

Jul. 29, 1996 [JP] Japan ..... 8-199322

[51] Int. Cl.[7] ..... H01R 4/48

[52] U.S. Cl. ..... 439/336; 439/611

[58] Field of Search ..... 439/332, 335, 439/336, 611, 613, 614, 616, 617, 736, 842, 843, 847, 918

[56] References Cited

U.S. PATENT DOCUMENTS 4,804,343 2/1989 Reedy ..... 439/336
5,154,645 10/1992 Harada et al. ..... 439/736
5,320,553 6/1994 Owaga et al. ..... 439/336
5,411,410 5/1995 Ogawa et al. ..... 439/336
5,511,988 4/1996 Ogawa et al. ..... 439/336

FOREIGN PATENT DOCUMENTS 1-106086 7/1989 Japan .

*Primary Examiner*—Hien Vu
*Attorney, Agent, or Firm*—Morgan, Lewis & Bockius LLP

[57] ABSTRACT

A bulb socket for receiving a base of a bulb, comprises: a bulb mounting hole into which the base of the bulb is mounted; a recessed portion formed in an inner peripheral surface of the bulb mounting hole; and an electrical connection terminal stored-in the recessed portion, the electrical connection terminal having a contact piece formed by cutting and raising a portion of the electrical connection terminal to project out from the recessed portion and contact with an outer peripheral surface of the bulb base, wherein the contact piece is bent at least two times toward the bulb mounting hole.

15 Claims, 6 Drawing Sheets

BULB SOCKET

BACKGROUND OF THE INVENTION

The present invention relates to a bulb socket into which a bulb with a base is to be mounted.

Conventionally, as a bulb socket into which a bulb with a base is to be mounted, there is known a bulb socket of as shown in FIG. 8. This bulb socket includes a socket main body 61 which is formed of synthetic resin as an integral body and, on one end side of the socket main body 61, there is formed a bulb mounting hole 62 into which a bulb 60 can be mounted. A pair of securing grooves 63 are respectively formed at the two positions of the inner peripheral surface of the bulb mounting hole 62, while the two securing grooves 63 are spaced 180° apart from each other. Each of the securing grooves 63 includes a guide portion 63*a* extending along the axial direction thereof and a bent portion 63*b* which is formed in the deepest end of the guide portion 63*a* such that it extends at right angles with respect to the guide portion 63; and, according to the shape thereof, the securing groove 63 is generally referred to as a J slot. Into the securing grooves 63, there can be engaged a pair of projections 65 which are respectively provided on the outer peripheral surface of a base 64 included in the bulb 60. And, on the bottom surface of the bulb mounting hole 62, there is mounted a positive side contact member 66 which is bent into an S shape. Also, the bulb mounting hole 62 includes a recessed portion 62*a* formed in the inner peripheral surface thereof, while a negative side contact member 67 is mounted in the recessed portion 62*a* such that it extends along the axial direction of the bulb mounting hole 62. Further, in the upper end portion of the negative side contact member 67, there is an elastic contact piece 68 formed by cutting and raising the present portion of the negative side contact member 67, while the elastic contact piece 68 is projected out from the recessed portion 62*a*.

In assembling the bulb 60 into the above-mentioned bulb socket, the projections 65 of the base 64 are pushed into their corresponding securing grooves 63 and, after then, the bulb 60 is rotated by a small angle to thereby cause the projections 65 to turn to the bent portion 63*b* side. As a result of this, the projections 65 are engaged with the bent portions 63*b*. Due to this, not only the bulb 60 can be mounted into the bulb socket such that it is prevented against removal, but also the positive side contact member 66 is elastically contacted with a positive side contact 69 provided on the leading end of the base 64 and the contact piece 68 of the negative side contact member 67 is elastically contacted with a negative side contact which is part of the outer peripheral surface of the base 64.

However, according to the structure of the above-mentioned conventional bulb socket, before the bulb with a base 60 is mounted into the bulb socket, if a tool such as a screwdriver or the like is erroneously inserted into the bulb mounting hole 62 of the bulb socket, then the tool might press against the contact piece 68 to push it deeper into the recessed portion 62*a*, thereby deforming the contact piece 68.

In addition to the above possibility, there is a fear that sufficient electrical connection cannot be secured between the contact piece 68 and base 64.

SUMMARY OF THE INVENTION

The present invention aims at eliminating the problems found in the above-mentioned conventional bulb socket. Accordingly, it is an object of the invention to provide a bulb socket which can secure electrical connection between a bulb base and an electrical connection terminal with higher reliability.

According to the present invention, there is provided a bulb socket for receiving a base of a bulb, comprising: a bulb mounting hole into which the base of the bulb is mounted; a recessed portion formed in an inner peripheral surface of the bulb mounting hole; and an electrical connection terminal stored in the recessed portion, the electrical connection terminal having a contact piece formed by cutting and raising a portion of the electrical connection terminal to project out from the recessed portion and contact with an outer peripheral surface of the bulb base, wherein the contact piece is bent at least two times toward the bulb mounting hole.

Furthermore, the bulb socket described above, wherein, even when the bent position of the contact piece just near the base portion thereof is pushed toward the recessed portion, the leading end of the contact piece is contactable with the base of the bulb.

Still further, the bulb socket described above, wherein the contact piece is bent toward the bulb mounting hole at a root position thereof at which the contact piece is cut and raised and at a position thereof existing in an area ranging from the middle portion thereof to the root side thereof in the longitudinal direction of the contact piece.

According to the invention, in the electrical connection terminal to be stored into the recessed portion of the bulb socket, by cutting and raising a portion of the electrical connection terminal, there is formed a contact piece which can be contacted with a contact provided on the outer peripheral surface of the base of the bulb and the thus cut and raised portion or contact piece is bent two or more times toward the bulb mounting hole. Thanks to this, even if an external force is applied to the contact piece while the bulb is not yet present and the root portion of the contact piece is thereby pushed back toward the recessed portion side, the leading end side of the contact piece keeps its bent state toward the bulb mounting hole due to the two or more times of bents thereof. As a result of this, the leading end portion of the cut and raised portion or the contact piece can be contacted with the base of the bulb, thereby being able to maintain a normal electrical contact state between the contact piece and the bulb base.

Also, according to the invention, even if the bent position of the contact piece just near to the base portion thereof is pushed toward the recessed portion side, the leading end of the contact piece is still positively contactable with the base of the bulb.

Further, according to the invention, the bent position of the contact piece is set at the two positions thereof, that is, the root position of the contact piece and the position thereof existing in an area ranging from the middle portion thereof to the root portion thereof. Therefore, according to the invention as set forth in claim 3, while satisfying the request that, even when the root side of the contact piece is pushed in the opposite direction, the leading end side thereof can be contactable with the base of the bulb, the leading end side of the contact piece to be contacted with the base of the bulb is so set as to have a length which allows it to be flexed easily. Due to this, the leading end side of the contact piece can be flexed with respect to the base of the bulb, that is, the contact piece can provide a reliable surface-to-surface contact with respect to the bulb base.

DETAILED DESCRIPTION OF THE PREFERRED EMBODIMENTS

Description will be given below of a first embodiment of a bulb socket according to the invention with reference to FIGS. 1 to 5. At first, in FIG. 1, there is shown a state of the first embodiment in which a bulb 1 with a base 3 is mounted in a bulb socket S.

Figure 1:
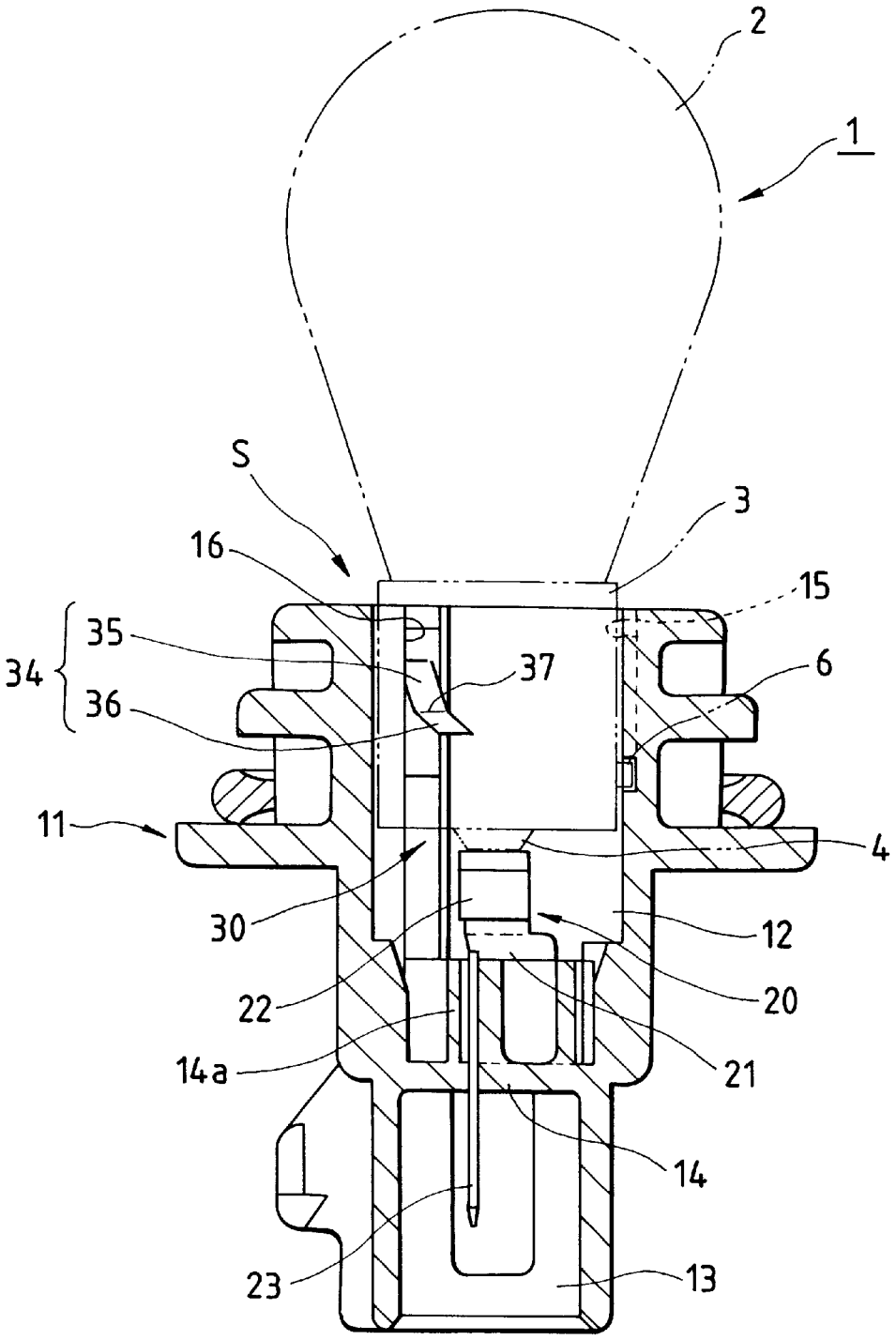
FIG. 1 is a side section view of a bulb socket according to a first embodiment of the invention.

The present bulb socket S comprises a socket main body 11 formed of synthetic resin as an integral body, and two positive and negative electrical contact members 20, 30. The interior of the socket main body 11 is divided by a partition 14 into upper and lower sections or spaces. In FIG. 1, in the upper space of the socket main body 11 interior portion, there is formed a bulb mounting hole 12 into which the bulb 1 can be mounted and, on the other hand, in the lower space thereof, there is formed a square-pillar shaped male connector portion 13 with which a female connector (not shown) can be fitted.

The bulb 1 includes in the upper portion thereof a bulb portion 2 which can light up and, in the lower portion thereof, the base 3 which can be electrically connected with the bulb socket S. On the lower end of the base 3, there is projectingly provided a positive-side contact 4 which can be connected with the positive side contact member 20. Connection with the negative side contact member 30 is executed on the side surface portion of the base 3. On the base 3, there are provided two projections 6 which are respectively so disposed as to correspond to securing grooves 15 which are respectively formed in the bulb socket S.

Figure 2:
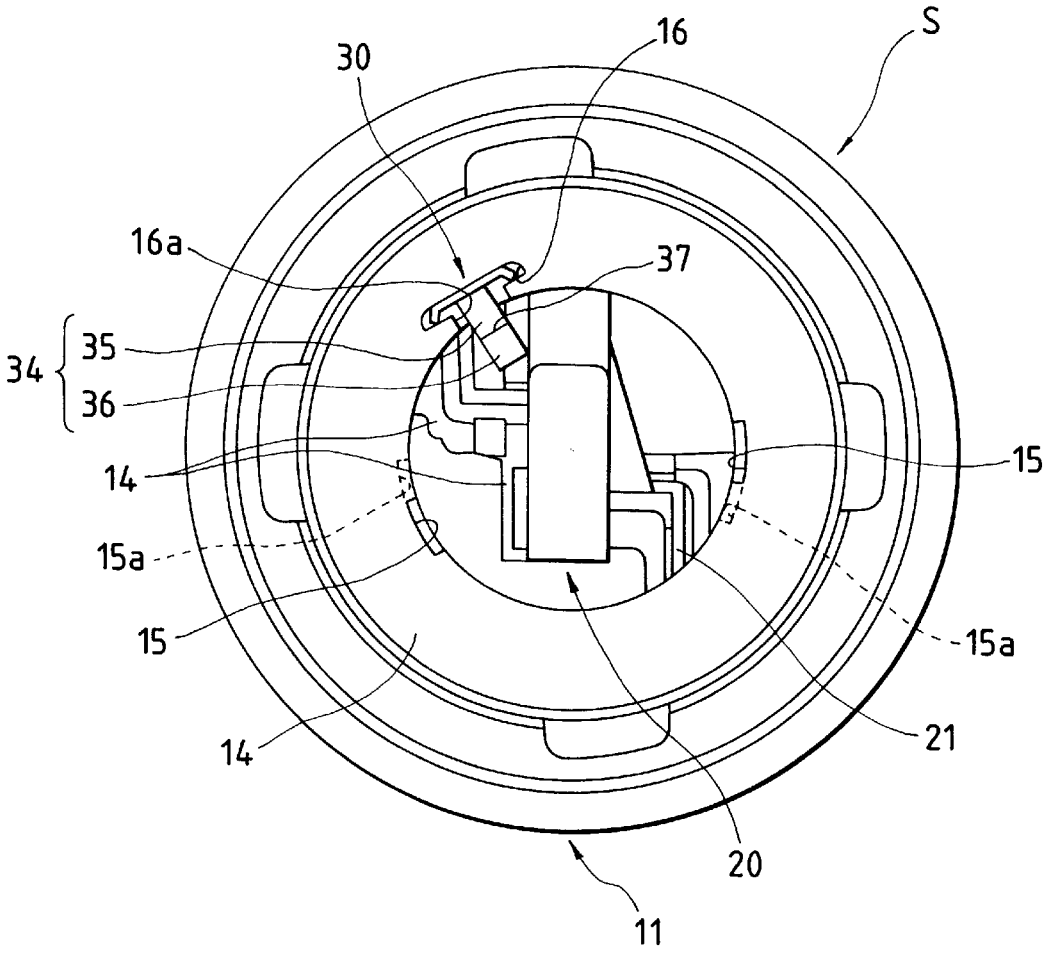
FIG. 2 is a plan view of a bulb socket according to the first embodiment.

And, the two securing grooves 15 are formed on the inner peripheral surface of the bulb mounting hole 12 in such a manner that, as shown in FIG. 2 which is a plan view of the bulb socket S, they are spaced a given distance apart from each other in the peripheral direction of the insertion hole 12. The two securing grooves 15 are formed in order that the above-mentioned projections 6 of the base 3 of the bulb 1 can be respectively inserted into the securing grooves 15. Each of the securing grooves 15 (J slot) is formed in such a manner that it includes a bent portion 15 in the leading end portion thereof which extends linearly along the axial direction of the bulb mounting hole 12 from the opened edge side of the bulb mounting hole 12 almost to the central portion of the bulb mounting hole 12. And, if the two projections 6 are secured to the two bent portions 15*a* respectively, then the bulb 1 can be mounted into the bulb socket S in such a manner that the bulb 1 is prevented against removal from the bulb socket S.

On a receiving portion 14*a* which is provided on and projected from the partition 14, there are mounted a main portion 21 of the positive side contact member 20 and a main portion 31 of the negative side contact member 30.

The positive side contact member 20 is formed of a metal plate by pressing the metal plate into an integral body. The main portion 21 of the positive side contact member 20, which is situated in the intermediate portion of the positive side contact member 20, includes on the upper portion thereof a contact portion 22 elastically contactable with the positive side contact 4 of the bulb 1 and on the lower portion thereof a tab portion 23 projecting downwardly therefrom. A portion of the main portion 21 may secure the positive side contact member 20 in place if the tab portion 23 of the main portion 21 of the positive side contact 20 is inserted into the securing receiving portion 14*a* from the top. Preferably, the main portion 21 is secured to the inner wall surface of the receive portion 14*a* to thereby prevent the positive side contact member 20 against removal. In this state, the tab portion 23 of the positive side contact member 20 is inserted through the male connector portion 13, while the contact portion 22 of the positive side contact member 20 is projected into the central portion of the bottom surface of the bulb mounting hole 12. Here, if the socket S uses a male connector portion 13 to be connected to a female connector, the tab portion 23 is connected with the terminals of the female connector to be attached to the male connector portion 13.

Figure 3:
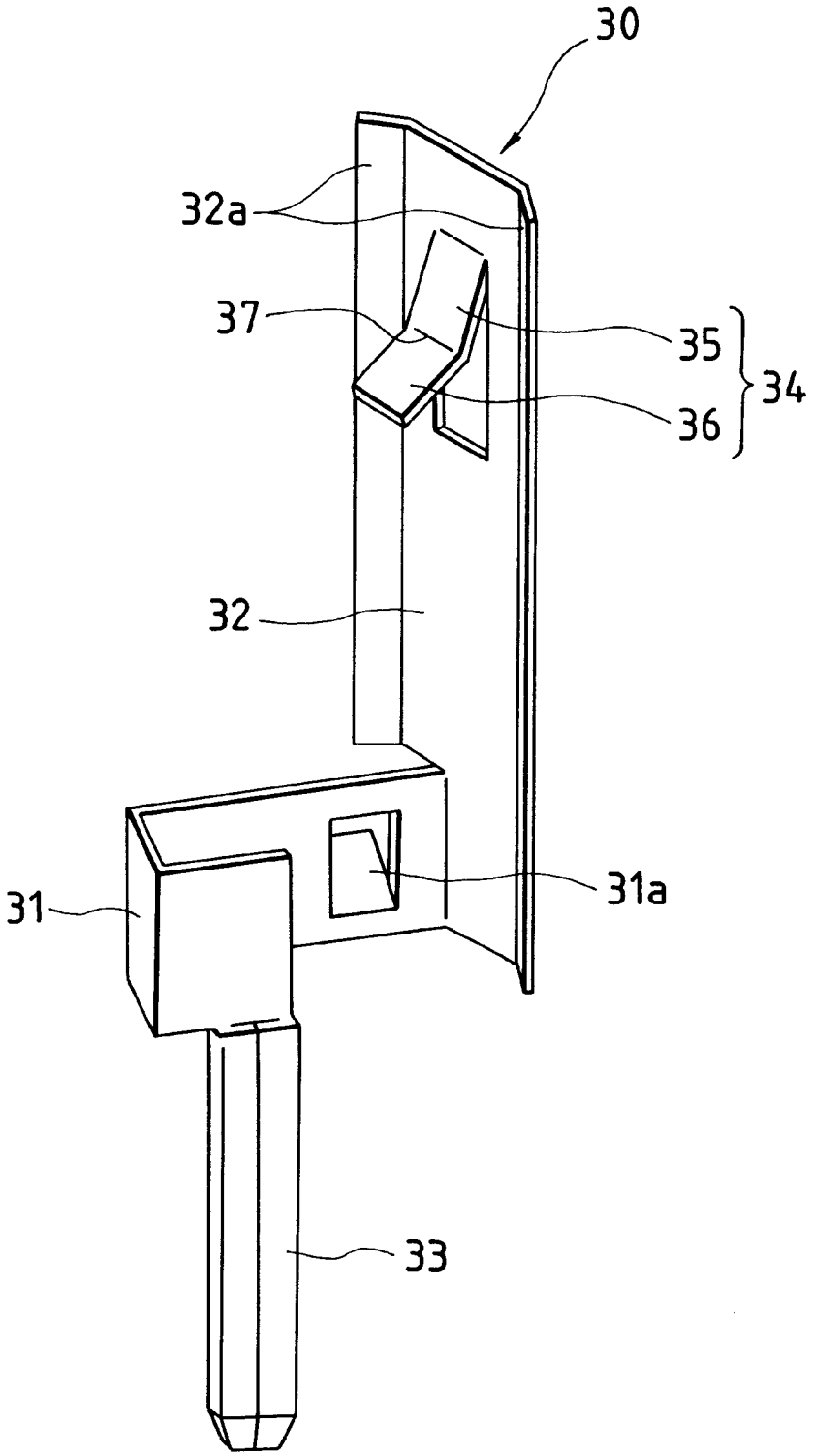
FIG. 3 is a perspective view of a negative side contact member employed in the first embodiment.
Figure 4:
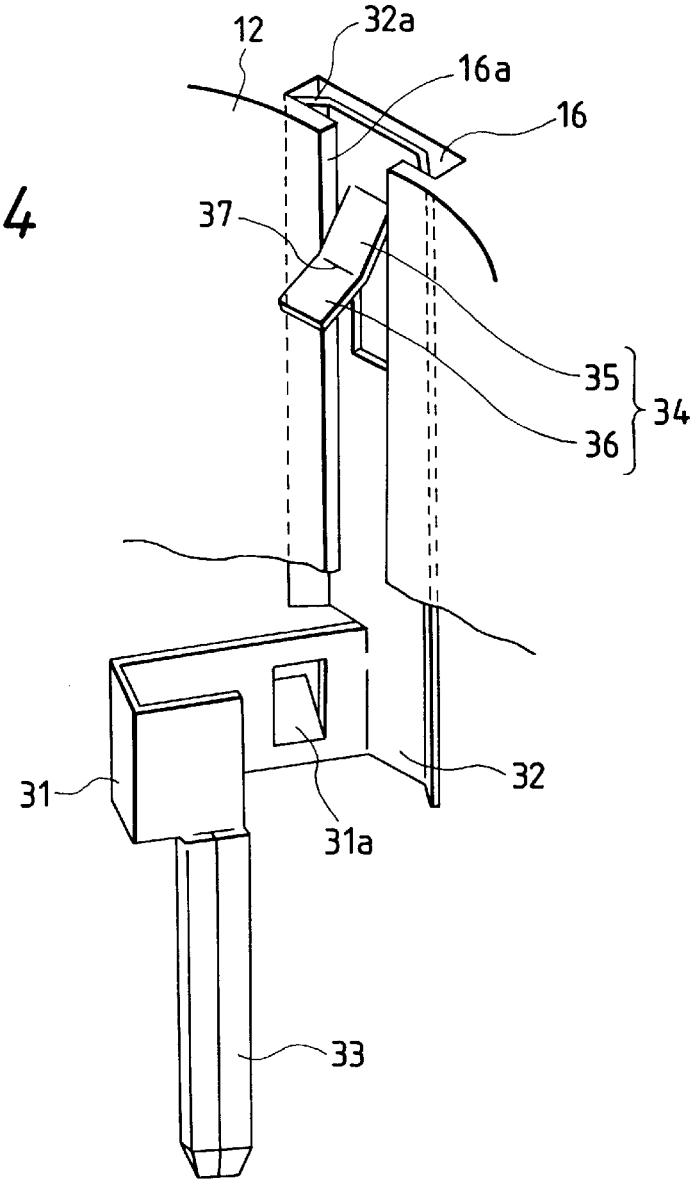
FIG. 4 is a perspective view of the negative side contact member employed in the first embodiment that shows a state in which the negative side contact member is mounted in a peripheral wall groove.
Figure 5:
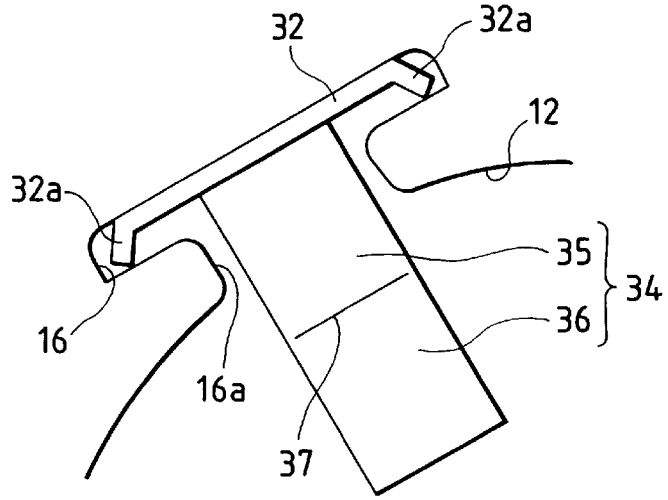
FIG. 5 is a partial plan view of the negative side contact member mounted in the peripheral wall groove in the first embodiment.

On the other hand, the negative side contact member 30, as shown in FIG. 3, is formed of a metal plate by pressing it into an integral body. If the negative side contact member 30 is contacted with the side surface of the base 3 of the bulb 1, then it cooperates with the positive side contact member 20 to supply power to the bulb 1. The negative side contact member 30 comprises a main portion 31 which is bent into a substantially J shape and is situated in the intermediate position of the negative side contact member 30, and a tab portion 33 which is projected downwardly from the main portion 31, and a plate portion 32 which extends upwardly from the main portion 31. The tab portion 33 is also connected with the tenninals of the female connector to be connected with the male connector portion 13.

The main portion 31 includes a securing piece 31*a* which is formed by cutting and raising a portion of the main portion 31 and is opened upwardly and, when the negative side contact member 30 is engaged with the positive side contact member 20, the securing piece 31*a* is secured to the inner wall surface of the receiving portion 14*a* to thereby prevent the negative side contact member 30 from being removed from the positive side contact member 20.

The plate portion 32 of the negative side contact member 30 includes, on the two sides thereof, two bent portions 32*a* which are respectively bent at an angle of about 45 degrees, while the two bent portions 32*a* can be inserted into a peripheral wall groove 16 formed in the peripheral wall of the bulb mounting hole 12. The peripheral wall groove 16 is so formed as to extend from the opened edge side of the bulb mounting opening 12 to the partition 14 along the axial direction of the bulb mounting hole 12. The peripheral wall groove 16, as shown in FIG. 16 which is a plan view of the negative side contact member 30, is structured such that the deep side thereof in the thickness direction of the peripheral wall of the bulb mounting hole 12 is formed in a flat space into which the plate portion 32 can be just stored. If the plate portion 32 is stored in such flat space, then the bent portions 32*a* are slightly flexed in their respective spreading directions and are thereby pressed against the inner wall surface of the flat space, thereby preventing the plate portion 32 from loosening.

On the upper end side of the plate portion 32, there is formed a contact piece 34. The contact piece 34 is structured in the following manner. That is, the free end portion of the contact piece 34 is cut and raised in such a manner that it projects obliquely in a downward direction, and the central portion of the thus cut and raised portion is bent again to form a bent edge 37, thereby providing first and second raised portions 35 and 36 with the central bent edge 37 as the boundary thereof. If the negative side contact member 30 is mounted into the peripheral wall groove 16, then the second raised portion 36 is projected out from the peripheral surface opening 16*a* of the peripheral wall groove 16 into the bulb mounting hole 12. And, if the bulb 1 is inserted here, then the two raised portions 35 and 36 are wholly flexed and the second raised portion 36 is elastically contacted with the side surface portion (outer peripheral contact) of the base 3.

Also, in a natural state (i.e., without the bulb 1 inserted), the angle of the bent edge 37, which serves as the boundary between the first and second raised portions 35 and 36, is set such that the leading end side of the bent edge 37 (i.e. the second raised portion 36) sufficiently projects from the surface of the peripheral surface opening 16*a*.

When the bulb 1 is not mounted in the bulb mounting hole 12, if a foreign body such as a screwdriver or the like is inserted high, then there is a high possibility that the base portion side (root side: the first raised portion 35 side) of the contact piece 34 can be pushed toward the peripheral wall groove 16. However, even in this case, due to provision of the above-mentioned twice bent structure, the second raised portion 36 side remains projected from the peripheral wall groove 16, thereby being able to secure a sufficient projection amount which allows the second raised portion 36 to be positively contacted with the base 3 of the bulb 1.

Next, description will be given below of the operation and effects of the first embodiment structured in the above-mentioned manner.

At first, the negative side contact member 30 is mounted into the socket main body 11. In particular, while the tab portion 33 is caused to face downwardly and the main portion 31 is caused to face a given position of the securing receiving portion 14*a*, the lower end edge of the plate portion 32 is moved along the upper end portion of the peripheral wall groove 16 of the bulb mounting hole 12 and inserted into the peripheral wall groove 16. As a-result of this, the contact piece 34 is caused to project out from the peripheral surface opening 16*a* into the bulb mounting hole 12. Next, the tab portion 23 of the positive contact member 20 is caused to face downwardly and is then mounted into a given position of the securing receiving portion 14*a*.

When mounting the bulb 1, while the two projections 6 of the bulb 1 are respectively matched to the entrances of the securing grooves 15, the base 3 of the bulb 1 is inserted into the bulb mounting hole 12. While the two projections 6 are moved along the securing grooves 15, the bulb 1 is inserted into the bulb mounting hole 12, thereby causing the positive side contact 4 provided on and projected from the bottom surface of the base 3 to compress the contact portion 22 of the positive side contact member 20. And, at a position where the two projections 6 respectively arrive at the lower end portions of the securing grooves 15, the bulb 1 is rotated in its engaging direction to thereby guide the projections 6 to the bent portions 15*a* of the securing grooves 15. And, at a position where the projections 6 respectively reach the deepest portions of the bent portions 15*a*, if the push-in motion of the bulb 1 is stopped, then the bulb 1 is lifted up due to the restitutive elasticity of the contact portion 22 of the positive side contact member 20 and thus the projections 6 are respectively secured to the upper portions of the bent portions 15*a*, thereby preventing the bulb 1 against removal. In this operation, the contact piece 34 is contacted with the peripheral surface of the base 3 with a certain contact pressure. At that time, even if the root portion of the contact piece 34 has been already deformed toward the peripheral wall groove 16 side, the leading end side of the contact piece 34 still keeps its bent state toward the bulb 1 side, thereby being able to maintain the electrical contact state of the contact piece 34 with respect to the bulb 1.

Figure 6:
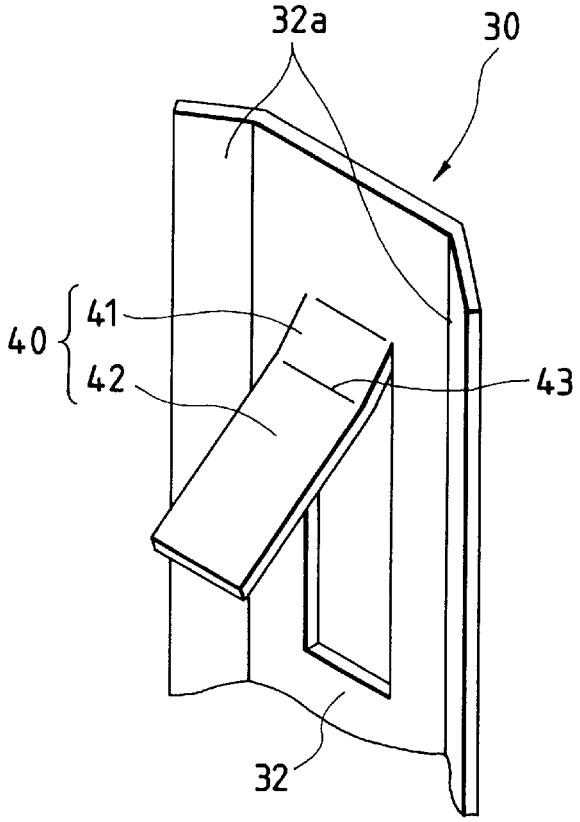
FIG. 6 is a partially perspective view of a negative side contact member employed in a second embodiment that shows a state in which the negative side contact member is mounted in a peripheral wall groove.
Figure 7:
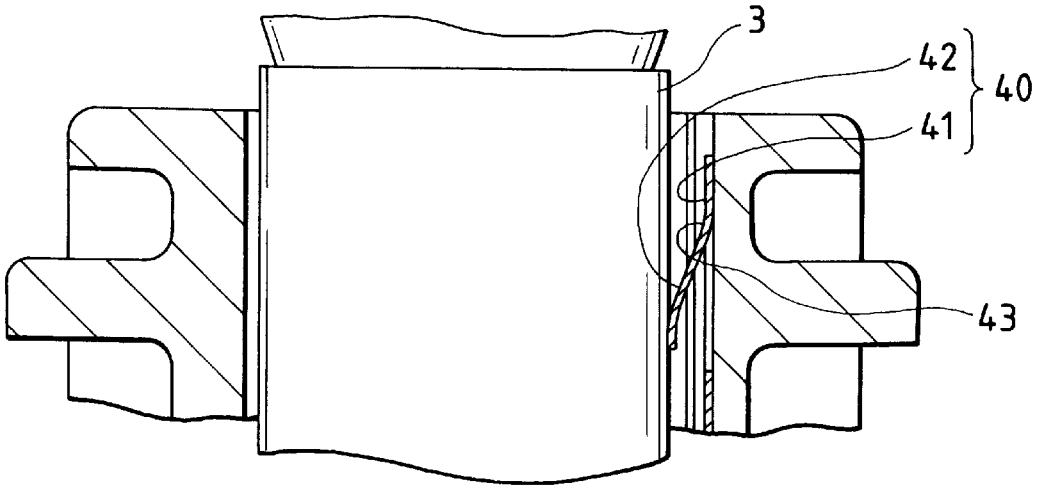
FIG. 7 is a partial side section view of the second embodiment that shows a state in which a contact piece is in contact with the base of a bulb; and, FIG. 8 is a side section view of a bulb with a base and a bulb socket according to the conventional art.
Figure 8:
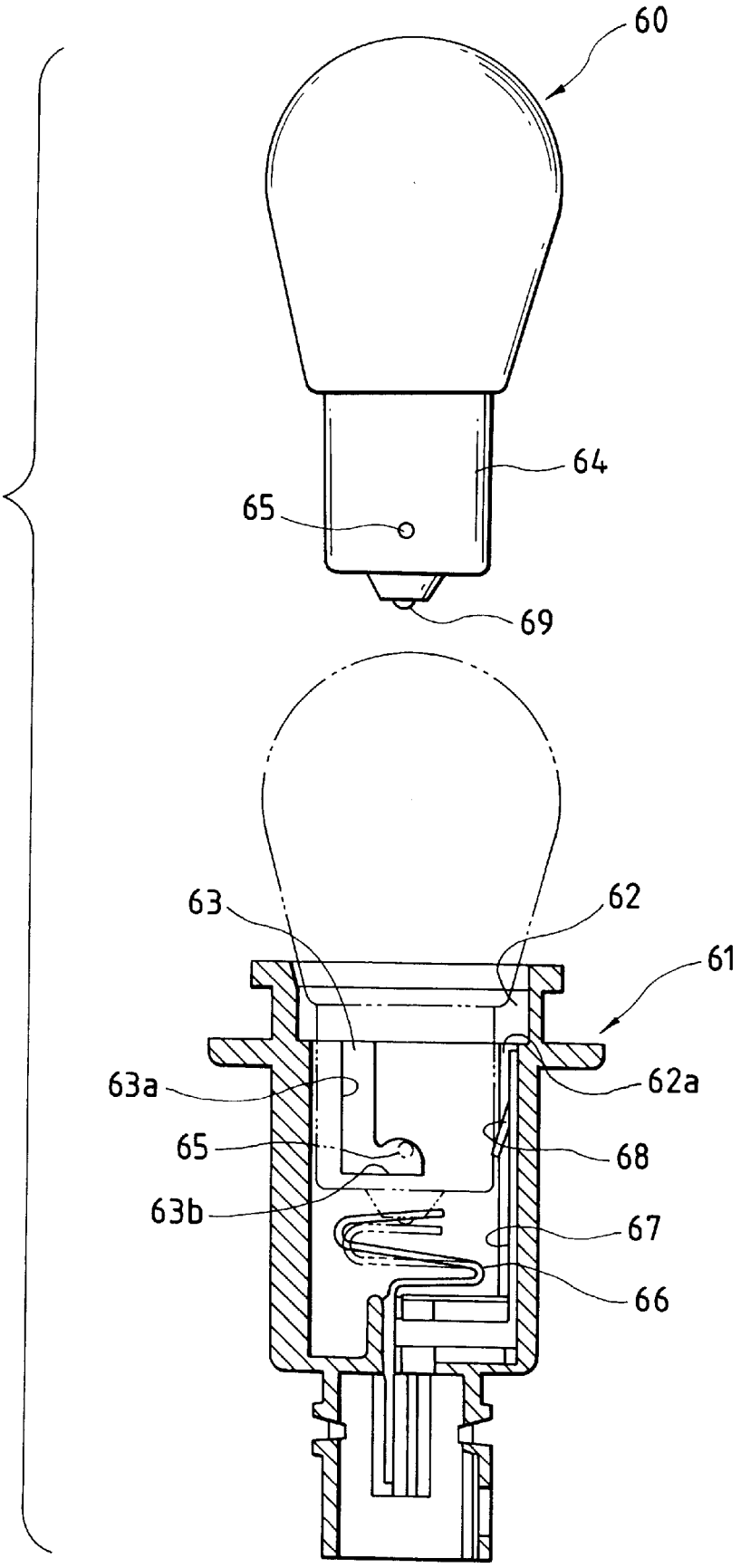

Next, a description will be given of a second embodiment of a bulb socket according to the invention with reference to FIGS. 6 and 7.

The second embodiment differs from the first embodiment only in the structure of a contact piece 40. Therefore, in the second embodiment, the same parts thereof as in the first embodiment are given the same designations and thus the description thereof is omitted here.

In the second embodiment, the contact piece 40 is bent toward the bulb mounting hole 12 in two positions thereof; that is, the root position thereof at which the contact piece 40 is cut and raised from the negative side contact member 30, and a bent edge 43 which is disposed nearer to the root side thereof than the middle portion of the contact piece 40. Thus, the contact piece 40 is composed of a base portion 41 situated near to the root side thereof and a raised portion 42 forming the leading end portion thereof. The raised portion 42 is formed larger in length than the base portion 41, which facilitates the flexing of the leading end portion of the contact piece 40.

If the negative side contact member 30 is mounted into the peripheral wall groove 16, the raised portion 42 is projected out from the peripheral surface opening 16*a* into the bulb mounting hole 12. If the bulb 1 is inserted here, then the raised portion 42 of the contact piece 40 is elastically contacted with the side surface portion (outer peripheral contact) of the base 3 through the leading end face thereof while the leading end portion thereof is being flexed downwardly.

As described above, in the present embodiment, since the bent edge 43 is disposed nearer to the root side of the contact piece 40 than the middle portion of the contact piece 40 and thus the raised portion 42 is formed larger in length, the contact piece 40 can be contacted with the base 3 of the bulb 1 by means of a surface-to-surface contact. Due to this, connection between the negative side contact member 30 and the base 3 of the bulb 1 can be achieved reliably and positively.

As can be understood clearly from the foregoing description, of course, the present embodiment also provides a similar effect to the first embodiment.

The present invention is not limited to the above-mentioned embodiments but, for example, the followings also fall within the scope of the invention:

That is:

(1) The positive and negative electrical contact members may also be inserted when the bulb socket is formed; and, (2) The number of times of the bending of the contact piece may be two or more.

What is claimed is:

1. A bulb socket for receiving a base of a bulb, comprising:

a body defining a bulb mounting hole into which the base of the bulb is mounted and a recessed portion formed in an inner peripheral surface of the bulb mounting hole; and an electrical connection terminal disposed in the recessed portion, the electrical connection terminal having a plate portion and a contact piece to project out from the plate portion and the recessed portion into the bulb mounting hole for contacting an outer peripheral surface of the bulb base, wherein the contact piece includes a first raised portion having a first bend and a second raised portion having a second bend such that each of the first and second raised portions are formed in a direction away from the inner peripheral surface toward a center of the bulb mounting hole and such that a distal end of the second raised portion of the contact piece is projected to be farther away from the plate portion than the first raised portion and to be closer to the center of the bulb mounting hole than any other portion of the contact piece.

2. The bulb socket according to claim 1, wherein when the first raised portion is pushed toward the recessed portion, the second raised portion remains contactable with the base of the bulb.

3. The bulb socket according to claim 1, wherein the first bend is disposed at a root position where the contact piece is attached to a main body of the plate portion and the second bend is disposed substantially at a middle of the contact piece.

4. The bulb socket according to claim 1, wherein the first bend is disposed at a root position where the contact piece attaches to the plate portion and the second bend is disposed closer to the root position than the distal end of the contact piece.

5. The bulb socket according to claim 1, wherein the first raised portion of the contact piece is defined between the first and second bends and the second raised portion of the contact piece is defined between the second bend and the distal end of the contact piece such that the first and second raised portions have sizes substantially the same.

6. The bulb socket according to claim 1, wherein the first raised portion of the contact piece is defined between the first and second bends and the second raised portion of the contact piece is defined between the second bend and the distal end of the contact piece such that the second raised portion is longer than the first raised portion.

7. The bulb socket according to claim 1, wherein the contact piece projects in a bulb insertion direction.

8. An electrical connection terminal of a bulb socket for being in contact with a base of a bulb, comprising:

a plate portion; and a contact piece to project out from the plate portion for contacting an outer peripheral surface of the bulb base, wherein the contact piece includes at least a first raised portion having a first bend and a second raised portion having a second bend, such that each of the first and second raised portions are formed in a direction away from the plate portion and such that a distal end of the second raised portion of the contact piece is projected to be farther away from the plate portion than the first raised portion and to be closer to the bulb than any other portion of the contact piece.

9. The electrical connection terminal according to claim 8, wherein when the first raised portion is pushed toward the plate portion, the second raised portion remains contactable with the base of the bulb.

10. The electrical connection terminal according to claim 8, wherein the first bend is disposed at a root position where the contact piece attaches to the plate portion and the second bend is disposed substantially at a middle of the contact piece.

11. The electrical connection terminal according to claim 8, wherein the first bend is disposed at a root position where the contact piece attaches to the contact plate and the second bend is disposed closer to the root position than the distal end of the contact piece.

12. The electrical connection terminal according to claim 8, wherein first raised portion of the contact piece is defined between the first and second bends and the second raised portion of the contact piece is defined between the second bend and the distal end of the contact piece such that the first and second raised portions have sizes substantially the same.

13. The electrical connection terminal according to claim 8, wherein the first raised portion of the contact piece is defined between the first and second bends and the second raised portion of the contact piece is defined between the second bend and the distal end of the contact piece such that the second raised portion is longer than the first raised portion.

14. The electrical connection terminal according to claim 8, wherein the contact piece projects in a bulb insertion direction.

15. A bulb socket for receiving a base of a bulb, comprising:

a body defining a bulb mounting hole into which the base of the bulb is mounted and a recessed portion formed in an inner peripheral surface of the bulb mounting hole; and an electrical connection terminal disposed in the recessed portion, the electrical connection terminal having a plate portion and a contact piece, the contact piece projecting out from the recessed portion into the bulb mounting hole for contacting an outer peripheral surface of the bulb base, wherein the contact piece includes a first bend defining a first raised portion and a second bend defining a second raised portion such that the first raised portion is projected out from the recessed portion and the second raised portion is continuously formed from the first raised portion in a direction away from the inner peripheral surface toward a center of the bulb mounting hole, wherein a first angle of the first raised portion with respect to a surface of the the plate portion is smaller than a second angle of the second raised portion with respect to an imaginary surface defined parallel to the surface of the plate portion.

* * * * *